United States Patent [19]

Baumann et al.

[11] Patent Number: 4,499,699

[45] Date of Patent: Feb. 19, 1985

[54] MOLDING DEVICE FOR SUB-SOIL CURTAIN WALL SECTIONS

[75] Inventors: Theodor Baumann, Ismaning; Otmar Schreyegg, Geretsried, both of Fed. Rep. of Germany

[73] Assignee: Philipp Holzmann Aktiengesellschaft, Frankfurt am Main, Fed. Rep. of Germany

[21] Appl. No.: 480,400

[22] Filed: Mar. 30, 1983

[30] Foreign Application Priority Data

May 17, 1982 [DE] Fed. Rep. of Germany ..... 3218516

[51] Int. Cl.[3] ..... E04B 1/00; E04G 21/00

[52] U.S. Cl. ..... 52/169.1; 52/169.14; 52/514; 52/742; 52/744

[58] Field of Search ..... 52/169.1, 169.5, 169.14, 52/514, 742, 744; 405/36, 42, 43, 45, 47, 48, 50, 51; 425/59

[56] References Cited

U.S. PATENT DOCUMENTS

| | | | |
|---|---|---|---|
| 4,211,050 | 7/1980 | Cvacho | 52/169.14 |
| 4,453,366 | 6/1984 | Piccagli | 52/169.14 |

FOREIGN PATENT DOCUMENTS

| | | | |
|---|---|---|---|
| 2524186 | 12/1976 | Fed. Rep. of Germany | 52/514 |
| 2108883 | 5/1972 | France | 52/169.1 |
| 363646 | 10/1938 | Italy | 52/169.1 |
| WO79/00851 | 11/1979 | PCT Int'l Appl. | 52/169.14 |
| 2037356 | 7/1980 | United Kingdom | 52/169.14 |
| 2042605 | 9/1980 | United Kingdom | 52/169.14 |

*Primary Examiner*—J. Karl Bell

*Attorney, Agent, or Firm*—Scully, Scott, Murphy & Presser

[57] ABSTRACT

By means of a moulding device for the fabrication of sub-soil curtain wall sections in the construction of the walls of sub-soil structures, measures are provided, even as the sub-soil curtain walls are being constructed, such that it is possible to introduce an injection of sealing compound into possible leakage points simply and optimumly after the building work has been completed. This arises according to the invention in that the molding device is a precast concrete structural part which remains in the sub-soil structure wall and which has at least one injection pipe which passes vertically therethrough and which is provided with injection valves for injecting leakage points with sealing compound.

12 Claims, 7 Drawing Figures

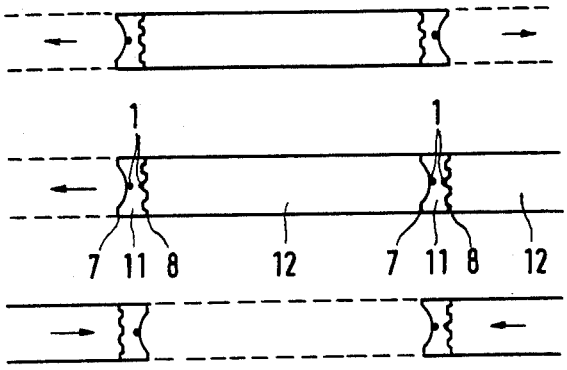
FIG. 5a
FIG. 5b
FIG. 5c
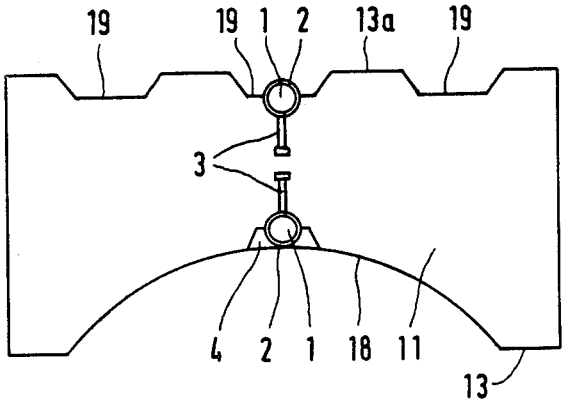
FIG. 4
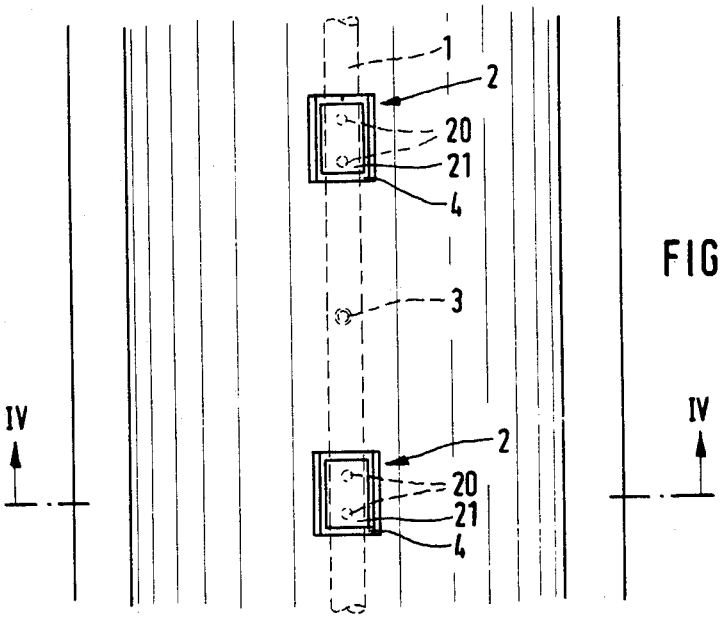
FIG. 3

MOLDING DEVICE FOR SUB-SOIL CURTAIN WALL SECTIONS

TECHNICAL FIELD OF INVENTION

The invention relates to a moulding device for the fabrication of sub-soil curtain wall sections in the construction of the walls of sub-soil structures (in such curtain walls, for example, as are called "Schlitzwände" in German building technology in which a slot is formed in the soil, the slot is filled with a water-Bentonit mixture and an underwater setting concrete is fed into the bottom of the slot displacing the water-Bentonit mixture).

BRIEF DESCRIPTION OF THE PRIOR ART

It has been established that in the construction of sub-soil structures in which there is utilization of the lower floors or basements in the region below the highest ground-water table, for example, for garages, engineering rooms, subway installations, and the like, the sub-soil curtain wall of the building excavation enclosure can indeed, in certain circumstances, also serve as the final or finished structure wall without any expensive ground-water insulation or sealing. When a structure wall of this type is constructed, however, it is necessary that the concrete joints at the edges of the sub-soil curtain wall sections are constructed so as to be thoroughly watertight. However, since such a sealing of leakage points is not always successful, attempts have been made to eliminate any leakages that may occur by the subsequent injection into the leakage points of a water-resistant, expandable sealing compound. However, for this, expensive drilling work from the inside of the wall is necessary therefor to enable the sealing compound actually to reach the leakage points.

OBJECT OF THE INVENTION

The invention as characterized in the claims has the object of eliminating the above-mentioned disadvantages by the creation of a moulding device, for sub-soil curtain wall sections of the kind initially referred to, whereby, even as the sub-soil curtain walls are being constructed, measures are provided such that subsequently, i.e. after completion of the building work, the injection of the sealing compound can be effected simply and optimumly into the leakage points.

The advantages provided by the invention are to be seen essentially in the fact that now, without any drilling work, effective injection of the sealing compound into the leaky concrete joints between the moulding-precast structural part and the sub-soil curtain wall sections can be carried out from a central location, and above all when the injection pipe is arranged in the central longitudinal axis of the concrete joint. Moreover, the injection of sealing compound can be carried out at the last possible moment, that is when the structure is already completed, and the sub-soil curtain wall is no longer subjected to any external temperature variations.

Advantageous embodiments of the invention are specified in the sub-claims and are illustrated below.

BRIEF DESCRIPTION OF THE DRAWINGS

One embodiment of the invention is shown, by way of example, in the drawing wherein.

FIG. 3 shows a cutaway portion of the precast moulding structural part viewed on a lateral surface of the precast structural part and to a larger scale than FIGS. 1 and 2;

FIG. 4 shows a section taken along the line IV—IV in FIG. 3;

FIG. 5 shows three plan views of parts of the structure wall,

FIG. 5*a* showing the initial section, FIG. 5*b* showing the consecutive section, and FIG. 5*c* showing the final section of the sub-soil curtain wall.

DETAILED DESCRIPTION OF THE PREFERRED EMBODIMENTS OF THE INVENTION

Figure 1:
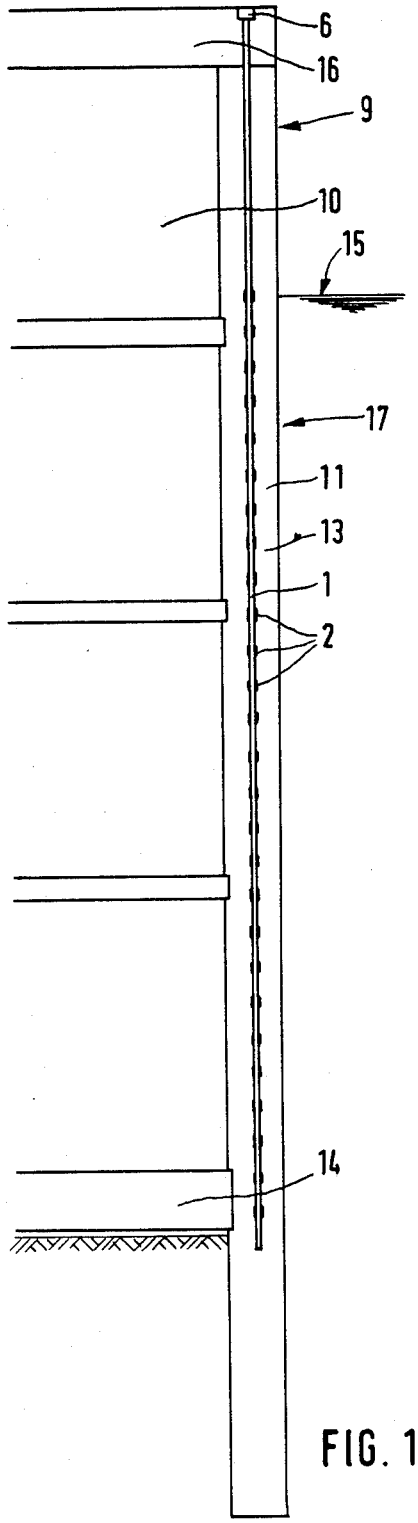
FIG. 1 shows a longitudinal section through a portion of the sub-soil structure in a plane which runs along the concrete joint between a moulding-precast structural part and a sub-soil curtain wall section.
Figure 2:
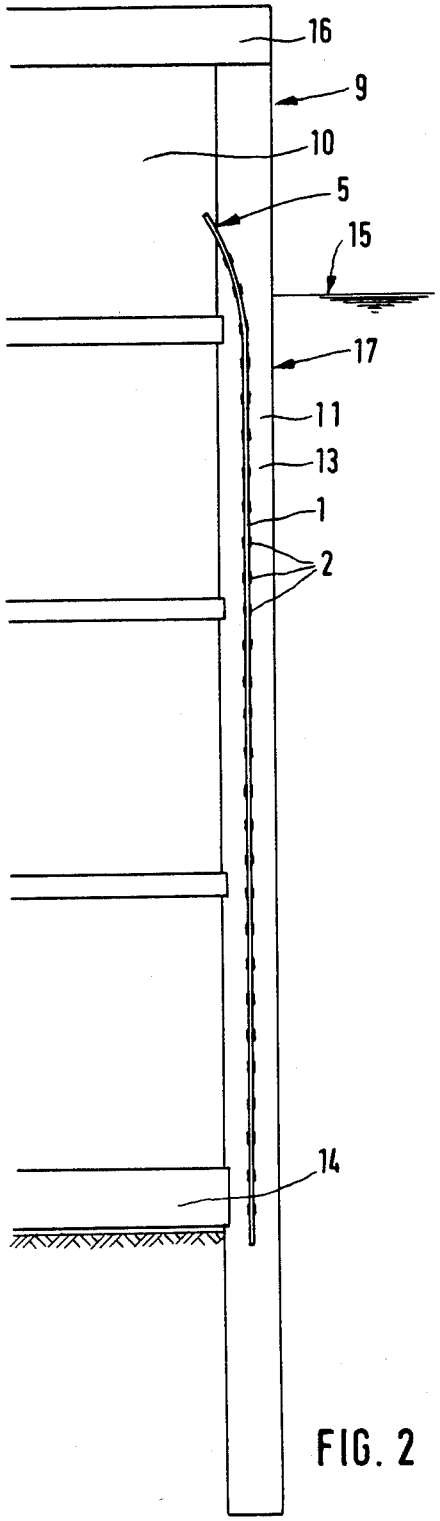
FIG. 2 shows the longitudinal section according to FIG. 1, although with a different upper exit for the injection pipe out of the sub-soil curtain wall.

As is shown in FIGS. 1 and 2, the sub-soil structure 9 has four lower floors, a base 14, a roof 16 and a lateral sub-soil curtain wall 17, the latter consisting of spaced columnar precast moulding structural devices or parts 11 adjacently positioned with sub-soil curtain wall sections 12 arranged therebetween (see FIG. 5). The moulding precast structural parts 11 remain as lost moulding parts in the completed sub-soil curtain wall 17. It can also be seen from FIGS. 1, 2 and 4 that each moulding part 11 is provided with injection pipes 1 having injection vents or valves (2) and running vertically from the base 14 of the structure to the upper deck 10.

An injection pipe 1 is disposed in each lateral surface 13 and 13*a* of the precast moulding part 11 and its upper end issues at 5, or higher at 6 from the roof 16 of the structure. These injection pipes 1 are, as shown in FIG. 5, arranged in the central longitudinal axis of the concrete joints 7 and 8 between the precast moulding part 11 and the adjacent sub-soil curtain wall sections 12.

This particular arrangement of the injection pipes 1 ensures that the sealing compound, which is introduced from above through the injection pipe 1 into the concrete joints 7 and 8, reaches in an optimum manner any possible leakage point.

This illustrated exemplary embodiment of the precast moulding part 11 has essentially a rectangular cross section with the opposite lateral surfaces 13 and 13*a* having different longitudinal profiles, as shown in FIGS. 4 and 5. These profiles consist, for the surface 13, of a wide longitudinal groove 18, having in cross section the form of a segment of a circle, and for the other surface 13*a*, of three narrow longitudinal grooves 19 having divergent lateral walls.

In the bottom of the wide longitudinal groove 18 and sunk into the surface 13 is the injection pipe 1, a recess 4 being provided in the bottom of the groove in the area of each injection vent or valve 2 in order to guarantee operability of the injection valve 2. On the opposite surface 13*a* of the precast moulding part 11, the injection pipe 1 is only semi-sunk into the bottom of the central narrow groove 19. Both injection pipes 1 are held securely in the precast moulding part 11 by means of anchoring elements 3 which are arranged between the injection valves 2.

Each injection valve 2 is formed as an automatically operating non-return valve by providing the injection pipe 1 at the relevant point with one or more openings 20 which are covered by means of a sleeve 21 of elastically expandable material which fits tightly against the injection pipe 1. As can be inferred from FIGS. 1 and 2, the injection valves 2 are arranged at equal distances from each other from the base 14 of the structure 9 to the highest ground-water table 15.

What is claimed is:

1. Moulding device for the fabrication of sub-soil curtain wall sections in the construction of the walls of sub-soil structures, characterized in that the molding device is a precast concrete structural part which remains in the wall of the structure and which has at least one injection pipe passing vertically therethrough and provided with injection valves for injecting leakage points with sealing compound.

2. Moulding device according to claim 1, characterized in that the injection pipe is arranged in the central longitudinal axis of the concrete joint between the precast structural part and a sub-soil curtain wall section.

3. Moulding device according to claim 1 or 2, characterized in that the injection pipe is secured in the precast structural part by means of anchoring elements which are arranged between the injection valves.

4. Moulding device according to claim 1, characterized in that the injection pipe is arranged so that it is sunk in the lateral surface of the precast structural part.

5. Moulding device according to claim 1, characterized in that the injection valves are distributed uniformly over the length of the injection pipe.

6. Moulding device according to claim 1, characterized in that the injection valves are arranged in recesses in the surface of the precast structural part.

7. Moulding device according to claim 6, characterized in that the recesses are lined.

8. Moulding device according to claim 1, characterized in that each injection valve is a non-return valve.

9. Moulding device according to claim 8, characterized in that the non-return valve consists of a sleeve of elastically expandable material which fits sealingly against the injection pipe and which shuts off one or more openings in the wall of the injection pipe at the relevant point.

10. Moulding device according to claim 1, characterized in that the injection valves are arranged on the injection pipe from the base of the sub-soil structure up to the highest ground-water table.

11. Moulding device according to claim 1, characterized in that at the top end the vertically arranged injection pipes run laterally inwards out of the sub-soil curtain wall into the top floor or deck of the structure.

12. Moulding device according to claim 1, characterized in that the top ends of the vertically arranged injection pipes open out from the roof of the structure.

* * * * *